United States Patent [19]

Tatsuno

[11] Patent Number: 4,967,852

[45] Date of Patent: Nov. 6, 1990

[54] OIL PRESSURE TYPE IMPULSE TORQUE GENERATOR FOR WRENCH

[75] Inventor: Koji Tatsuno, Osaka, Japan

[73] Assignee: Uryu Seisaku, Ltd., Osaka, Japan

[21] Appl. No.: 386,590

[22] Filed: Jul. 31, 1989

[51] Int. Cl.[5] ..... B25D 15/00

[52] U.S. Cl. ..... 173/93; 173/93.5; 464/25

[58] Field of Search ..... 173/93, 93.5; 464/25, 464/26; 81/463

[56] References Cited

U.S. PATENT DOCUMENTS

| | | | |
|---|---|---|---|
| 3,292,391 | 12/1966 | Kramer et al. | 173/93 |
| 3,952,814 | 4/1976 | Gelfand et al. | 173/93 |
| 4,553,948 | 11/1985 | Tatsuno . | |
| 4,766,787 | 8/1988 | Sugimoto et al. | 173/93.5 X |

*Primary Examiner*—Frank T. Yost
*Assistant Examiner*—Willmon Fridie, Jr.
*Attorney, Agent, or Firm*—Wenderoth, Lind & Ponack

[57] ABSTRACT

An oil pressure type impulse torque generator for a wrench. Either one of both seal surfaces on the main shaft side and the liner side is made a variable type by floating in order to eliminate "burning" and wear at the seal surfaces. The seal surfaces may be formed by rollers.

10 Claims, 4 Drawing Sheets

OIL PRESSURE TYPE IMPULSE TORQUE GENERATOR FOR WRENCH

BACKGROUND OF THE INVENTION

1. Field of the Invention:

This invention relates to an oil pressure type impulse torque generator for a torque wrench and the like, which is entirely free from "burning phenomenon" at the seal surfaces of a main shaft and a liner.

2. Description of the Prior Art:

Torque wrenches which are pneumatic tools used in bolt tightening operations and the like generate impact by a mechanical method based on the turning power of a rotor and such impact is converted into the desired torque. As the impact torque obtained by this mechanical method involves high impact noise, it can cause noise pollution. Also, there is a risk of operators being affected by Steinbrocken syndrome or Raynaud's phenomenon due to vibration caused by impact. With this in view, torque wrenches which use oil pressure for obtaining impact torque to prevent noises and vibration have been developed. Such torque wrenches have an oil pressure type torque generator with one blade or a plurality of blades at a main shaft (four blades in the case of Japanese Patent Application Publication Gazette No. 41-5800). In the case of the former or the single blade construction, oil pressure in a rotatable liner through which a main shaft is put, namely, oil pressure of the impact torque generator becomes higher, for which a more precise and stronger sealing construction is required. In the case of the latter or the construction using plural blades, an impact is generated at least twice in each revolution of the liner.

SUMMARY OF THE INVENTION

Although the number of impacts generated in one revolution of the liner differs with the number of blades, the oil pressure type impulse torque generator will have better sealability if a clearance between seal surfaces of the liner and the main shaft is made smaller and as a result, internal pressure rises and accordingly output also rises. However, due to the rise of internal pressure "burning" at the seal surfaces of the liner and the main shaft is liable to take place.

With the above in view, in the oil pressure type impulse torque generator comprising a main shaft, a liner rotatable by a rotor and having an oval-shaped cavity, seal surfaces made at the inner circumferential surface of said cavity, one being close to a minor shaft and the other being at the outer circumferential surface of a main shaft carrying two blades, whereby internal pressure is raised and pulse is generated by oil pressure, the present invention is characterized in that either one of the seal surfaces on the liner side and on the main shaft side is a floating type seal surface.

BRIEF DESCRIPTION OF THE DRAWINGS

The nature and advantages of the present invention will become more apparent from the following description made with reference to the accompanying drawings, in which.

DETAILED DESCRIPTION OF THE INVENTION

Figure 1:
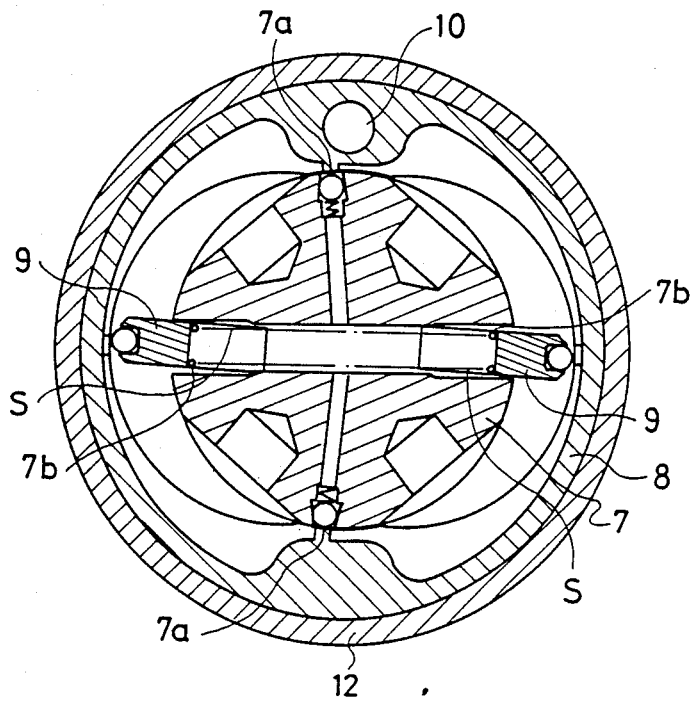
FIG. 1 is a cross sectional view of an oil pressure pressure type torque generator.

An explanation is made below about the present invention on the basis of an embodiment illustrated in the drawing.

Reference numeral 1 designates a main body of a wrench having therein a main valve 2 which carries out supply and stoppage of supply of high pressure air, a switchover valve 3 (normal and reverse turning) and a rotor 4 which causes high pressure air fed from the above valve group to generate turning torque. Thus, the wrench according to the present invention has a motor construction typical of general pneumatic tools.

An oil pressure type impulse torque generator which converts turning torque of the rotor 4 into impulse torque is provided in a front case 6 which projects at a top end portion of the main body 1.

The oil pressure type impulse torque generator 5 has in its liner case 12 a liner 8 which is rotatable about a main shaft 7 and has an inside caliber eccentric to the main shaft 7 working oil for generating torque is filled and tightly sealed in the liner 8. Two blade insertion grooves *7b*, opposite to each other, on a diametrical second shaft line which passes through the center of the main shaft 7 are provided in the main shaft 7. A blade 9 is fitted in each of the two grooves *7b* in such a fashion that the two blades 9 are always forced to project reciprocally in the outer circumferential direction of the main shaft 7 by springs S. The thickness of the blade 9 is made smaller than the width of the groove *7b* and seal surfaces *7a* of floating and variable type are formed at the outer circumferential surface of the main shaft 7 between the two blades. These seal surfaces *7a* are provided in such a fashion that they project a little from the outer end surface of the main shaft and are on a first shaft line which crosses at a right angle to the straight line connecting the two blade insertion grooves *7b*.

Figure 2:
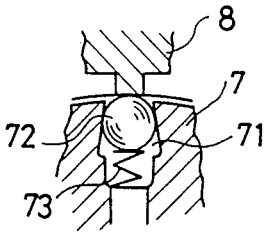
FIG. 2 is a cross section, on an enlarged scale, of the seal surface on the major shaft side which is of roller type.

Formation of this seal surface *7a* of floating and variable type is carried out as follows. As shown in FIG. 2, a groove 71 of dovetail shape is made in the main shaft 7. A roller 72 is inserted in the groove 71 in such a fashion that it does not fly off in a radial direction of the main shaft 7 even by centrifugal force at the turning of the main shaft. This roller 72 is freely rotatable within the groove 71 and is movable within the range allowed in the groove by the centrifugal force and spring pressure. Thus, projection of the roller 72 from the outer circumferential surface of the main shaft 7 is made variable. A leaf spring 73 or a spring of other type is interposed between the roller 72 and the bottom of the groove 71.

Figure 3:
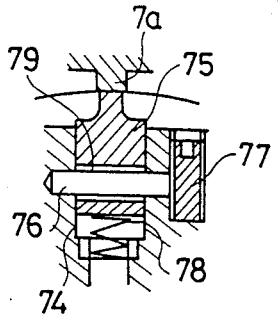
FIG. 3 is a cross section, on an enlarged scale, of the seal surface on the major shaft side which is of blade type.

Regarding a seal surface 7*a* shown in FIG. 3, a blade 75 is inserted in a groove 74 made in the main shaft 7 and is forced to project a little from the groove 74 by the spring pressure of a leaf spring 78 or the like interposed between the inner bottom surface of the groove 74 and a lower side surface of the blade 75. In order to prevent the blade 75 from projecting from the groove 74 beyond the permitting range due to spring pressure or centrifugal force, a pin hole 79 is made in the main shaft 7 in the direction intersecting the groove 74 and an antislip pin 76 is inserted in the pin hole 79. A fixing screw 77 is threaded into the main shaft for fixing one end of this antislip pin 76.

The hole diameter of the pin hole 79 is made larger than the diameter of the antislip pin 76 so that the blade is permitted to project from the groove in the radial direction relative to the main shaft by the difference in the diameter namely, the difference in diameters corresponds to the quantity of projection allowed for the blade.

Figure 6A:
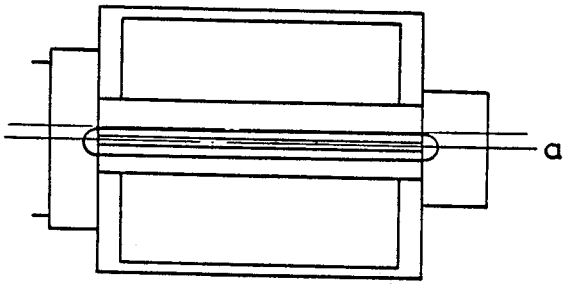
FIG. 6 (A), (B) and (C) show respectively an embodiment of a different seal surface on the major shaft side.
Figure 6B:
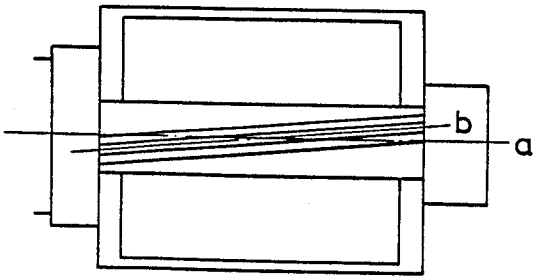
Figure 6C:
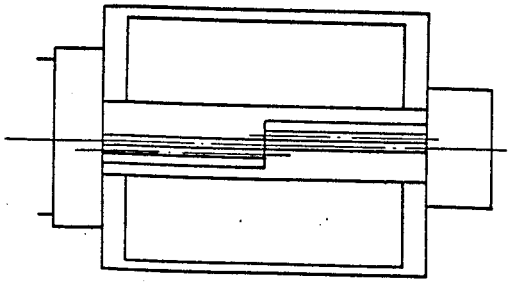
Figure 8:
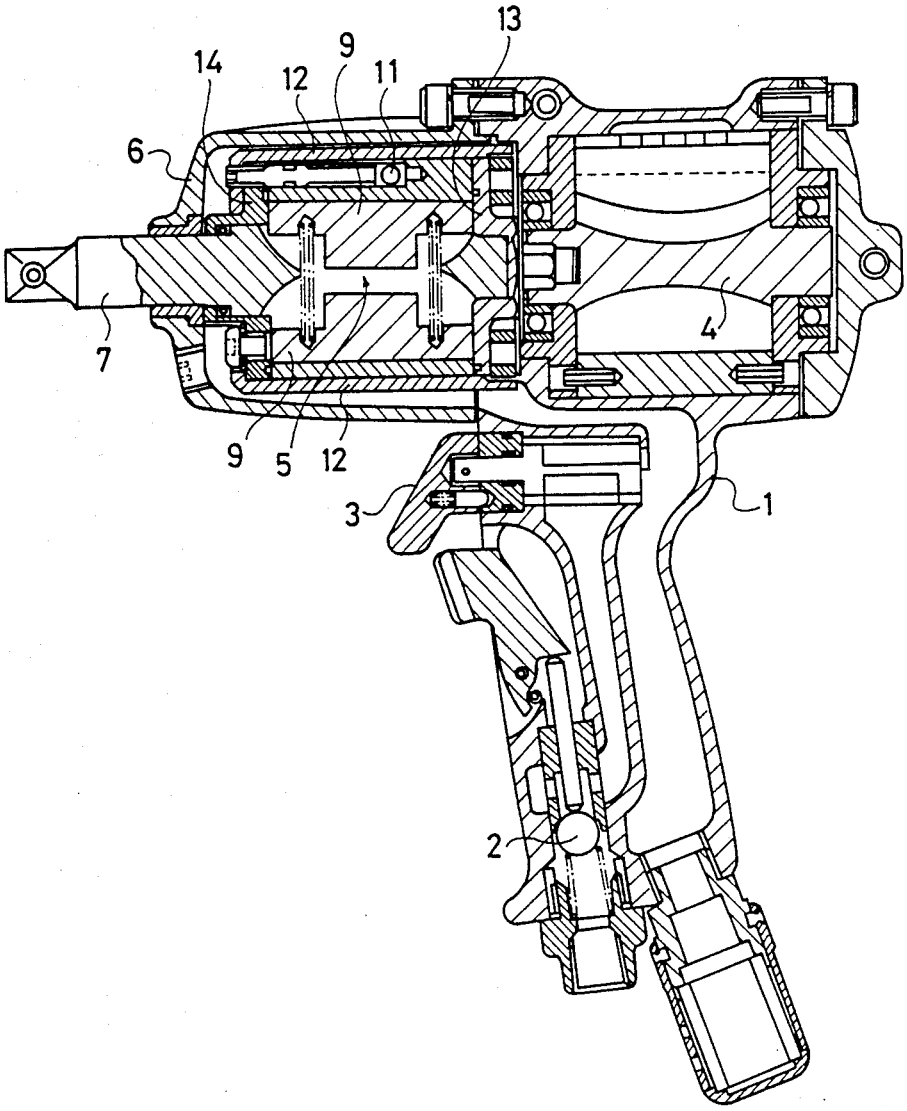
FIG. 8 is a cross section of an oil type wrench in which the present invention is incorporated.

The seal surface 7*a* formed in floating type on the main shaft 7 is available in various shapes, namely, in parallel with the shaft center in lengthwise direction of the main shaft as shown in FIG. 6(A), or, the shaft center b with a certain inclined angle with respect to the shaft center a in lengthwise direction as shown in FIG. 6(B), or, in crank shape as shown in FIG. 6(C). When two seal surfaces 7*a* are formed with respect to one main shaft, in the developed drawing each seal surface 7*a* is arranged in such a fashion that it is dissymmetrical to the axial line a.

The liner 8 in which the main shaft 7, having the two blades 9 projecting in opposite directions and the seal surfaces 7*a*, is fitted forms on a line chamber of oval shape in section, as shown in FIG. 1. The inner circumferential surfaces of the opposite constricted parts of the liner 8 protrude from the inner circumferential surface of the other part of the liner 8 and on such protrusions are made seal surfaces 8*a* which intersect a straight line a passing through the center of the liner 8.

Figure 4:
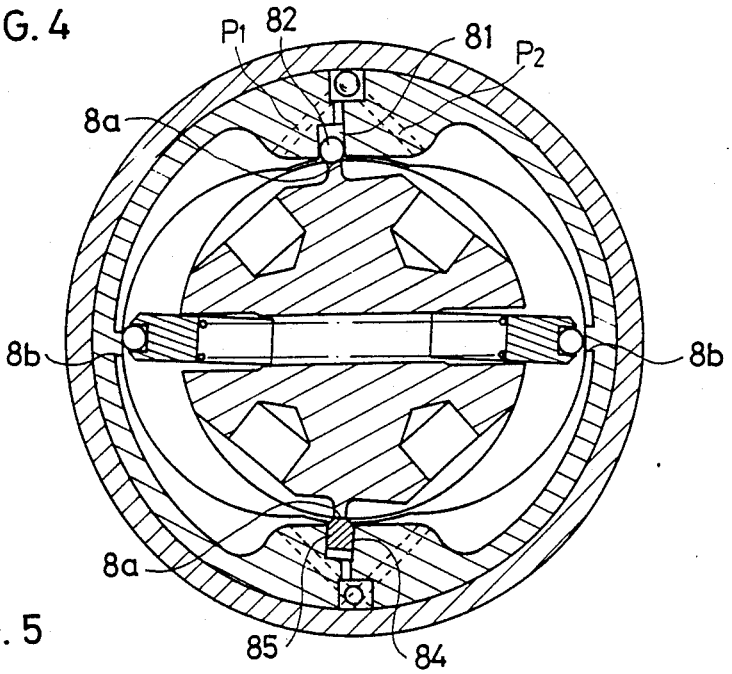
FIG. 4 is a side view, in vertical section, of the seal surface of the liner side which is of floating type.
Figure 5:
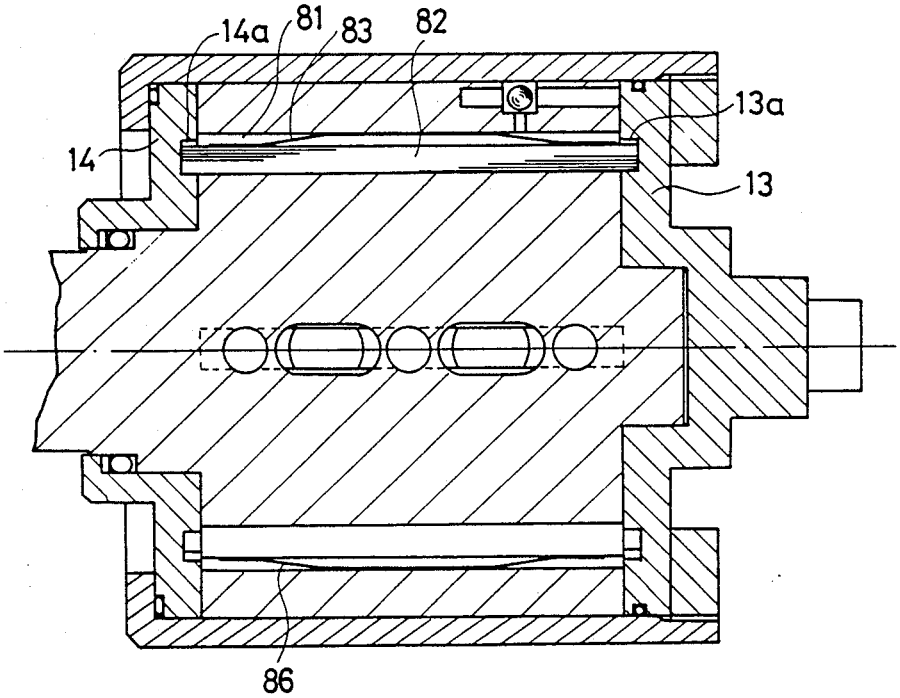
FIG. 5 is a front view, in vertical section, of the seal surface shown in FIG. 4 (both in FIG. 4 and FIG. 5, the upper half is of roller type and the lower half is of blade type)

In FIG. 4 and FIG. 5, the upper half and the lower half show a roller type, and a plate type respectively. At the seal surfaces 8*a* of roller type, a roller 82 is slidably fitted in a groove 81 made in the seal part. A leaf spring 83 is interposed between the bottom surface of the groove and the roller 82, whereby the roller 82 is imparted with the force to protect from the inner circumferential surface of the liner. Both end portions of the roller 82 is supported by roller supporting grooves 13*a*, 14*a* made in a liner upper lid 13 and a liner lower lid 14, respectively. Grooves 13*a*, 14*a* are made slightly longer than the diameter of the roller 82 and this difference between the groove length and the roller diameter corresponds to a quantity of projection of the roller to be permitted. By this arrangement, the roller 82 is prevented from springing out of the groove 81 in its entirety. Similarly, in the seal surface 8*a* of blade type a blade 85 is put slidably in a groove 84 with a spring thereunder. Irrespective of whether the seal surface 8*a* is of plate type or roller type, the seal surface 8*a* does the same action, namely, it cooperates with the seal surface 7*a* on the main shaft 7 side for a sealing up action.

In the case where the seal surface 7*a* on the main shaft side is of floating type, the seal surfaces on the liner side is to be of conventional fixed type and in the case where the seal surface 8*a* on the liner side is of floating type, the seal surface on the main shaft side is to be of fixed type. At any rate, either one of the seal surface 7*a* (on the main shaft side) or the seal surface 8*a* (on the liner side) may be of floating type.

Figure 7A:
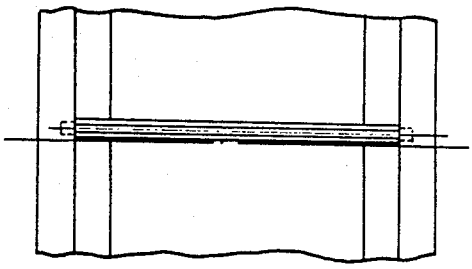
FIG. 7 (A), (B) and (C) show respectively an embodiment of a different seal surface on the liner side.
Figure 7B:
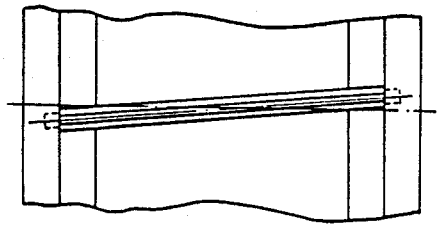
Figure 7C:
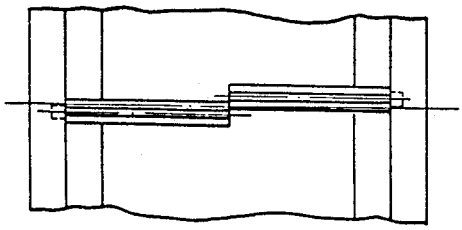

The seal surface 8*a* on the liner side is formed selectively in any one of the shapes shown in FIG. 7 (A), (B) and (C).

The seal surface 8*a* and the seal surface 7*a* at the liner and the main shaft respectively are formed correspondingly. Under this arrangement, when the liner 8 turns about the outer circumference of the main shaft 7 put in the liner chamber, the seal surface 8*a* makes contact with or gets near the seal surface 7*a* of the main shaft 7, and when both seal surfaces coincide completely with each other, hermetical sealing results and the liner chamber is divided into two by the seal surfaces 7*a*, 8*a*. At the middle position between both seal surfaces on the inner circumferential surface of the liner 8, seal surfaces 8*b* may make contact with top ends of the blades 9 and cause the two blades 9 and both seal surfaces 7*a*, 8*a* to temporarily divide the liner chamber into four rooms. These seal surfaces 8*b* are opposite to each other, with their centers coinciding with a straight second axis line passing the center of the liner chamber. An output adjust valve inserting hole 10 is made at one of the seal surfaces 8*b* of the liner 8 in parallel with the liner chamber or in parallel with an axial center of the liner. At the innermost recess of the hole 10, ports P1 and P2 are made so that each of the at least two rooms partitioned by the seal surface of the main shaft and the blade may communicate with the output adjust valve inserting hole 10. An output adjust valve 11 is fitted adjustably in said hole 10.

When pressurized air is introduced into a rotor room in the main body 1 by operating the main valve 2 and the switchover valve 3, the rotor turns at a high speed. The turning force of this rotor is transmitted to the liner 8 provided at a rotor axis. This liner 8 is supported rotatably at its outer circumference by the cyclindrical liner case 12. The liner upper lid 13 and the liner lower lid 14 are provided at both end portions of the case 12 so that working fluid in the liner chamber is hermetically sealed. In the state where pulse or impact force is generated, the seal surfaces 7*a* of the main shaft and the blades 9 make contact with the seal surfaces 8*a* and the seal surfaces 8*b* of the liner, respectively, and the liner chamber is divided into two rooms (right and left) with the opposite two blades on a straight line therebetween. Each of the right hand left rooms is further divided into an upper room (high pressure room H) and a lower room (low pressure room L) by seal surfaces 7*a*, 8*a*. Substantially, the high pressure room H and the low pressure room L are formed on both sides of the blades. When the liner 8 is rotated further by rotation of the rotor 4, immediately before the moment of impulse the volume of the high pressure room H is decreased but the volume of the low pressure room L is increased and when the two rooms with the blades therebetween are completely in confied states, high pressure is generated at the high pressure room H and the side of the blade 9 is momentarily pressed to the low pressure, room L side by this oil pressure and such impulse force is transmitted to the main shaft in which the blades are inserted. Thus the desired intermittent torque is generated at the main shaft and the desired operation is carried out. When the liner turns 90° after torque was generated at the main shaft, the high pressure room H and the low pressure room L with the blades therebetween communicate with each other. Thus, the liner chamber as a whole is divided into two rooms of the same pressure and no torque is generated at the main shaft. Under this pressure condition, the liner turns another 90° by the rotation of the rotor, namely, the liner turns 180° from the time of impulse. In this state, since the seal surfaces 8*b* of the liner and the seal surfaces 7*a* of the main shaft, opposite to each other, intersect the axial line a passing through the center, clearance is generated between both seal surfaces 7*a*, 8*a* and the liner chamber is divided into two rooms by the main shaft and the upper and lower blades. This is substantially the same state as the state when the liner turns 90° from the time of impulse, namely, no pressure change is generated and the whole liner room is under the same pressure. Therefore, the liner rotates freely. The state of the liner when it turns further 90°, namely, turned 270° from the time of impulse, is substantially the same as the state when the liner turned 90° and the only difference is that the position of the output adjust valve is turned upside down. If the liner further turns from this state, the liner chamber which has been divided into right and left two rooms is further divided into four rooms, namely, by the contact of the blades with the seal surfaces 8*b* and the contact of both seal surfaces 7*a*, 8*a* on the main shaft side and on the liner side with each other. Thus a pressure difference is generated between rooms on both sides with the blades therebetween and an impulse force is generated. In this way, a strong impulse is generated once each revolution of the liner. Adjustment of this impulse force is done by output adjust valve 11 by using the conventional method.

The above embodiment refers to a two-blade type device but is applicable to a one-blade type device.

According to the present invention, where the rise in internal pressure is obtained by hermetically sealing between the seal surfaces of the liner and the seal surfaces of the main shaft and a pulse is generated by oil pressure, either one of both seal surfaces is made a variable type by floating and therefore follows the distortion of the liner. The seal surfaces vary and as a result, neither "burning" nor wear takes place. Moreover, as the seal surfaces of the main shaft and the liner vary, even if "burning" due to distortion of the liner is prevented by enlarging the tolerance of the liner inside diameter or the main shaft outside diameter, high pressures can be obtained without impairing the seal at both seal surfaces.

What is claimed is:

1. An impulse wrench, comprising:

a housing;

a liner rotatably mounted within said housing and having a longitudinal axis and a cavity of elliptical cross-section extending along said axis, an inner peripheral surface of said cavity having a first pair of liner seals extending in the direction of said longitudinal axis and disposed in opposed relation on a first axis line perpendicular to said longitudinal axis, and a second pair of liner seals extending in the direction of said longitudinal axis and disposed on said surface in substantially opposed relation on a second axis line perpendicular to both said longitudinal axis and said first axis line, and containing said axis line;

means for rotating said liner about said longitudinal axis;

a main shaft disposed within said cavity coaxially to said longitudinal axis, an outer peripheral surface of said shaft having a first pair of shaft seals extending in the direction of said longitudinal axis and disposed in opposed relation to a first shaft line perpendicular to said longitudinal axis, and a pair of blade grooves extending in the direction of said longitudinal axis and disposed on a second shaft line perpendicular to both said longitudinal axis and said first shaft line, and containing said longitudinal axis, said main shaft including a blade mounted within each of said blade grooves, each of said blades being biased outwardly from said main shaft substantially along said second shaft line and including an outer face, and said main shaft further including a roller mounted in said outer face of each of said blades, each said roller being mounted for rotation about an axis substantially parallel to said longitudinal axis, whereby said rollers form a second pair of shaft seals, said first shaft seals and said first liner seals being adapted to cooperate to form fluid seals, and said second shaft seals and said liner seals being adapted to cooperate to form fluid seals.

2. A wrench as in claim 1, wherein each of said first pair of shaft seals is defined by a groove in said main shaft extending in the direction of said longitudinal axis, and a second roller mounted in each said groove, each said second roller being biased outwardly of said main shaft substantially along said first shaft line and being mounted for rotation about an axis substantially parallel to said longitudinal axis.

3. A wrench as in claim 1, wherein each of said first pair of shaft seals is defined by a groove in said main shaft extending in the direction of said longitudinal axis, and a second blade mounted in each said groove, each said second blade being biased outwardly of said main shaft substantially along said first shaft line.

4. A wrench as in claim 1, wherein at least one of said pairs of liner seals is defined by grooves in said liner extending in the direction of said longitudinal axis, and a second roller mounted in each said groove, each said second roller being biased inwardly of said liner substantially along the associated said axis line and being mounted for rotation about an axis substantially parallel to said longitudinal axis.

5. A wrench as in claim 1, wherein at least one of said pairs of liner seals is defined by grooves in said liner extending in the direction of said longitudinal axis, and a second blade mounted in each said groove, each said second blade being biased inwardly of said liner substantially along the associated said axis line.

6. A wrench as in claim 1, wherein said second axis line defines a major axis of said elliptical cavity, and said first axis line and said first shaft line are spaced from said longitudinal axis by a distance along said second axis line and second shaft line, respectively.

7. A wrench as in claim 2, wherein each of said first pair of shaft seals is defined by a groove in said main shaft extending in the direction of said longitudinal axis, and a second roller mounted in each said groove, each said second roller being biased outwardly of said main shaft and being mounted for rotation about an axis substantially parallel to said longitudinal axis.

8. A wrench as in claim 3, wherein each of said first pair of shaft seals is defined by a groove in said liner extending in the direction of said longitudinal axis, and a second blade mounted in each said groove, each said second blade being biased outwardly of said main shaft.

9. A wrench as in claim 4, wherein each of said first pair of liner seals is defined by a groove in said liner extending in the direction of said longitudinal axis, and a second roller mounted in each said groove, each said second roller being biased inwardly of said liner and being mounted for rotation about an axis substantially parallel to said longitudinal axis.

10. A wrench as in claim 5, wherein each of said first pair of liner seals is defined by a groove in said liner extending in the direction of said longitudinal axis, and a second blade mounted in each said groove, each said second blade being biased inwardly of said liner.

* * * * *